US005387018A

United States Patent [19]

Pinkerton

[11] Patent Number: 5,387,018

[45] Date of Patent: Feb. 7, 1995

[54] CHILD PROOF REFRIGERATOR DOOR LATCH

[76] Inventor: William R. Pinkerton, 1024 Calle Escondida, Brownsville, Tex. 78521

[21] Appl. No.: 140,851

[22] Filed: Oct. 25, 1993

[51] Int. Cl.[6] ..... E05C 19/18

[52] U.S. Cl. ..... 292/259 R; 292/106; 292/262; 292/DIG. 71

[58] Field of Search ..... 292/259, 262, 281, 288, 292/106, DIG. 28, DIG. 43, DIG. 53, DIG. 65, DIG. 71

[56] References Cited

U.S. PATENT DOCUMENTS

| | | | |
|---|---|---|---|
| 1,445,157 | 2/1923 | Noller | 292/281 |
| 2,663,585 | 12/1953 | Tye | 292/106 |
| 3,117,689 | 1/1964 | Dedic, Sr. | 292/DIG. 43 X |
| 3,583,738 | 6/1971 | Uphoff | 292/67 |
| 3,653,703 | 4/1972 | Lochner | 292/106 |
| 4,288,119 | 9/1981 | Geiger | 292/262 |
| 4,647,091 | 3/1987 | Roubin | 292/DIG. 53 X |
| 5,114,193 | 5/1992 | Nass | 292/DIG. 71 X |

*Primary Examiner*—Rodney M. Lindsey
*Attorney, Agent, or Firm*—Daniel Vera

[57] ABSTRACT

A device or kit for making a refrigerator door child proof is disclosed. The device comprises about four distinct parts: a shock cord, a spring clasp, one adhesive backed mounting plate or pad with a loop for receiving the spring clasp, another adhesive backed pad for mounting the latch and lanyard to. The loop pad is adhered to refrigerator door. The other pad having the latch and lanyard mounted thereto is either adhered to a second door or the side of the refrigerator. The latch can be operated by one hand. The latch can be disabled by leaving the latch unhooked. Dependent claims include additional features separately or combined: double spring clasp, clock, telephone, night light, can opener, writing surface, fan, timer, alarm, motion detector, bottle opener, and paper clamp.

4 Claims, 4 Drawing Sheets

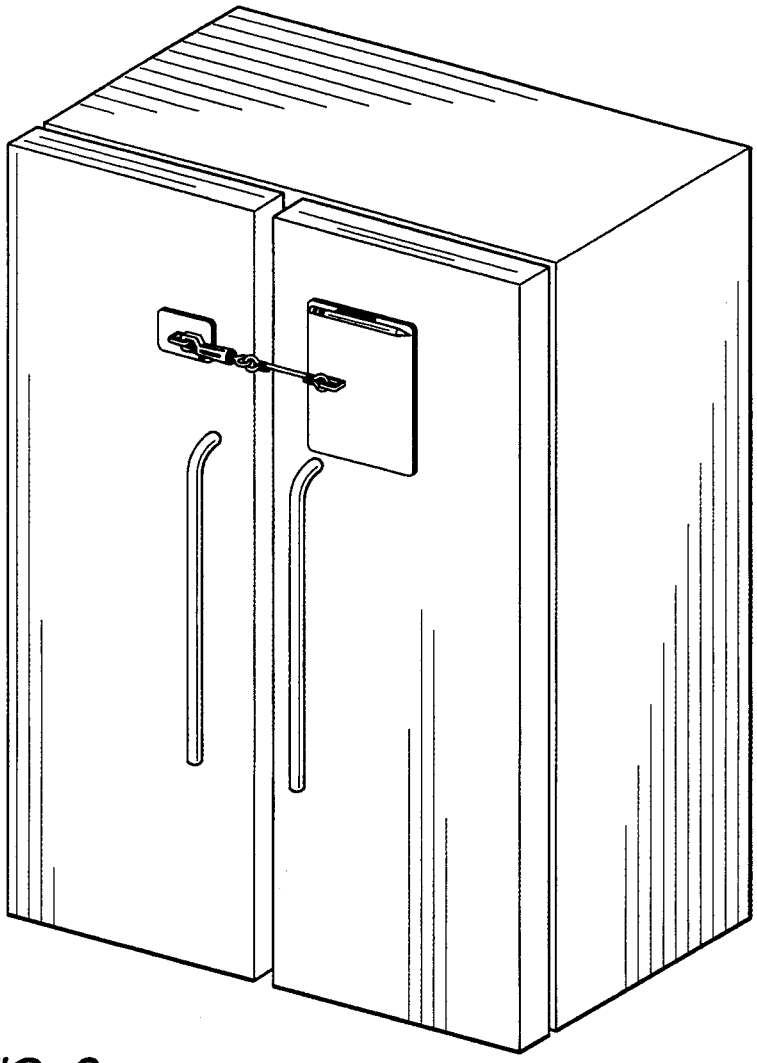
FIG. 5
FIG. 6
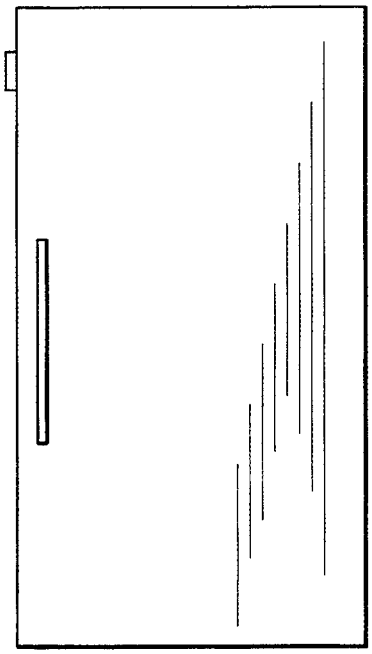
FIG. 7
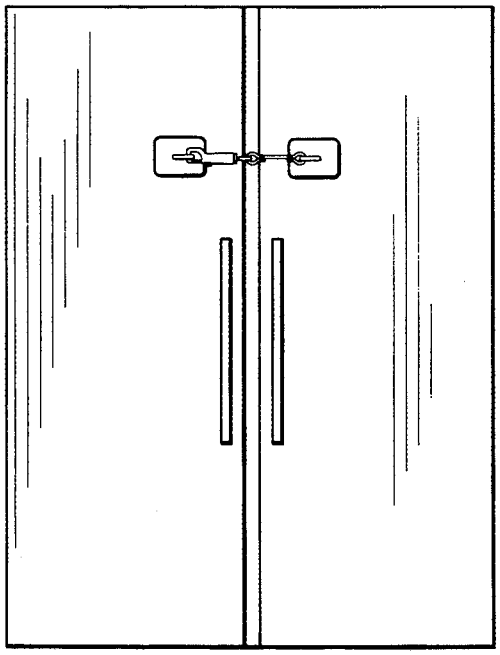

CHILD PROOF REFRIGERATOR DOOR LATCH

BRIEF SUMMARY OF INVENTION

This invention relates to a child proof refrigerator door latch. The latch comprises about four distinct parts: a shock cord, hereafter sometimes referred to as an elastic lanyard, a safety latch, hereafter sometimes referred to as a spring clasp, one adhesive backed mounting plate or pad with a loop for receiving the latch, another adhesive backed pad for mounting the latch and lanyard to. The loop pad is adhered to refrigerator door. The other pad having the latch and lanyard is either adhered to a second door or the side of the refrigerator. The latch can be operated by one hand. The latch can be disabled by leaving the latch unhooked. When the latch is engaged to the looped pad the elastic lanyard works by reclosing the refrigerator door when opened by child of modest strength. After several attempts the child becomes frustrated and ceases to operate the door.

BACKGROUND OF THE INVENTION (1) Field of Invention (2) Background Art

Child proof latches are known and refrigerator door locks are known it is believed however that to date there has not been a child proof refrigerator door latch made or conceived that is within the parameters of the instant invention. Cabinet door or drawer child proof locks are typically comprised of two parts where one part is usually mounted to a fixed surface and the other part is mounted to a moving surface such as a door or drawer. The pieces usually automatically engage each other thus becoming latched or mated upon closure of a door or drawer and remain hidden within the closure. Unlatching the pieces usually involves slightly opening the door or drawer and disengaging the locked pieces manually. these latch typically cannot be disabled and cannot operate to reclose a slightly opened door.

One design U.S. Pat. No.D324,367 and D326,402 displays the above mentioned features for a refrigerator door latch and its operation is readily understandable to wit: it is made of two pieces, one piece has a resilient arm with a hole in it for receiving a catch. The catch is on the other piece. Both pieces have an adhesive surface for mounting to refrigerator type doors. One piece operates as a fixed hook and the other piece is an elongated loop which springs over and automatically engages the hook whenever the door is closed. Apparently the pieces are made to allow for a margin of error in placement of the pieces in their operative relative juxtaposition.

The present invention relates to a child proof refrigerator door latch, which comprises about five major elements which are: Two independent mounting plates, adhesive backing on each of the two independent mounting plates, a spring closed latch hook clasp having a butt end and a releasable clasping end, hereafter clasp, and an elastic lanyard. One of the two mounting plates hereafter the first mounting plate, further comprises a loop on its outer surface for receiving the clasp. the other mounting plate, hereafter the second mounting plate, further comprises a loop for securing one end of approximately from 2 to 10 inches of elastic lanyard to it. The loops may be identical. The mounting plates may be identical. A, preferably plastic, spring closed latch hook is attached at it's butt end to the unattached end of the lanyard. The first mounting plate is fixed to a refrigerator door preferably above the reach of children. The second mounting plate is fixed to the refrigerator main body or a second refrigerator door, so that the clasping end of the clasp can easily engage the loop on the first mounting plate. DISTINCTION: Though child proof door latches, are known in the art, the inventor feels his invention is distinct. The advantages are: that the refrigerator door is made child proof; that the latch can be disabled; the margin of error in mounting the device is greater; the mounted pieces may be identical; but need not be; the lanyard operates to reclose a refrigerator door saving energy and cold atmosphere within the refrigerator; the reclosing effect operates to frustrate repeated attempts to open the refrigerator door by a child of moderate strength ultimately resulting in the child's disinterest in opening the refrigerator door.

BEST MODE FOR CARRYING OUT THE INVENTION

The present invention relates to a child proof refrigerator door latch, which comprises about five major elements which are: Two independent mounting plates, adhesive backing on each of the two independent mounting plates, a spring closed latch hook clasp having a butt end and a releasable clasping end, hereafter clasp, and an elastic lanyard having a limited stretch capability of from about sixty percent of diameter to about 250 percent of diameter. One of the two mounting plates hereafter the first mounting plate, further comprises a loop on its' outer surface for receiving the clasp. the other mounting plate, hereafter the second mounting plate, further comprises a loop for securing one end of approximately from 2 to 10 inches of elastic lanyard to it. The loops may be identical. The mounting plates may be identical. A preferably plastic spring closed latch hook is attached at it's butt end to the unattached end of the lanyard. The first mounting plate is fixed to a refrigerator door preferably above the reach of children. The second mounting plate is fixed to the refrigerator main body or a second refrigerator door, so that the clasping end of the clasp can easily engage the loop on the first mounting plate.

Another equally good embodiment differs from the above only in that the lanyard is made to have a spring closed hook clasp at both ends thus allowing disablement at either end such as may be preferable in side by side refrigerator door configurations.

DESCRIPTION OF THE DRAWINGS

FIG. 5 Shows the mounting of an alternate embodiment.

FIG. 6 Shows attachment of the device to the top side of a refrigerator having a single door.

FIG. 7 Shows a front mount for side by side doors.

DETAILED DESCRIPTION

This invention provides a child proof door latch mechanism for a refrigerator door.

Figure 1:
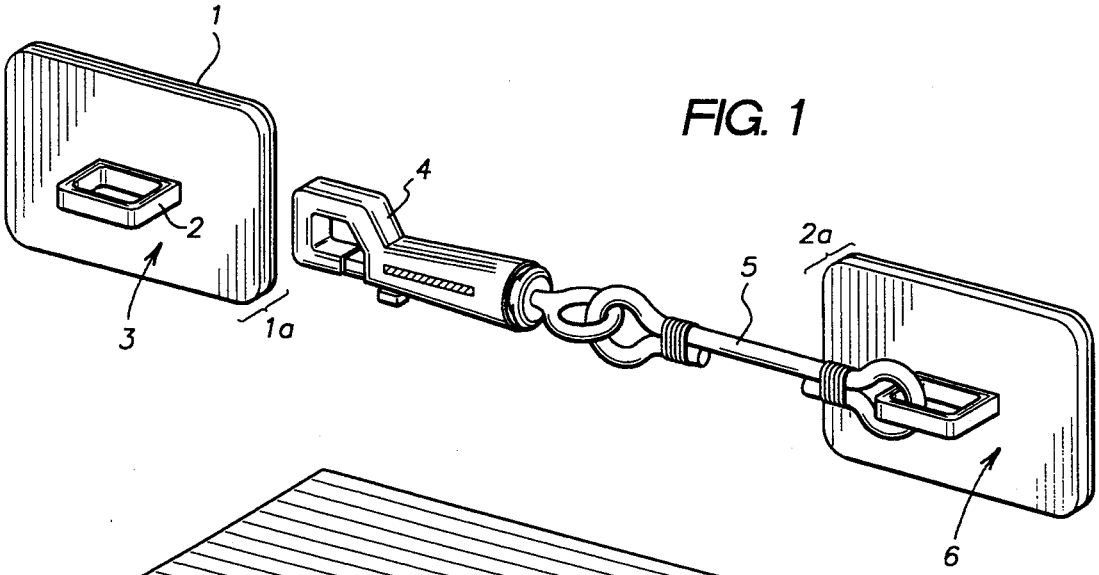
FIG. 1 is a pictorial view of the component parts of a refrigerator door child proof mechanism.
Figure 2:
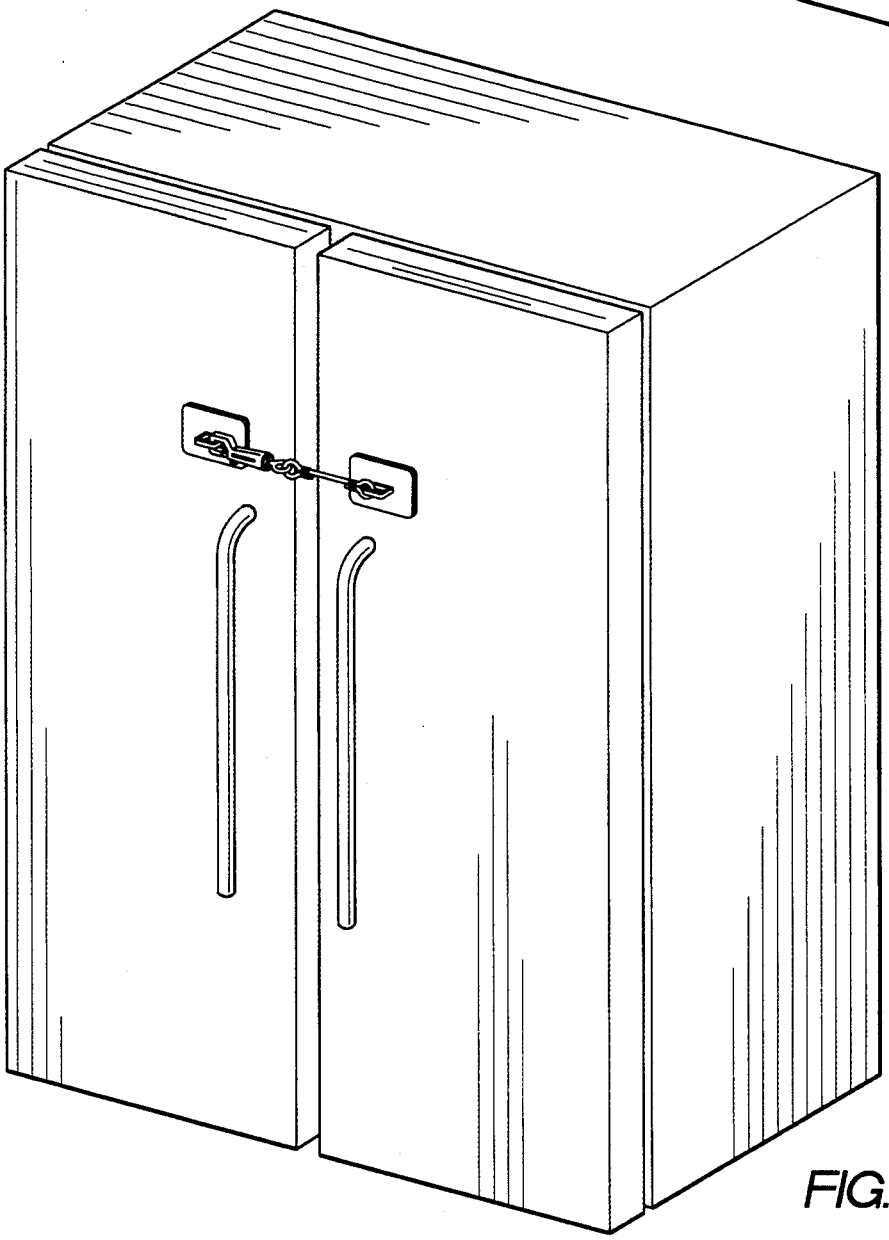
FIG. 2 is a view of assembled pieces of a device for making a refrigerator door child resistant and showing their interaction and how they may be mounted on a refrigerator door.
Figure 3:
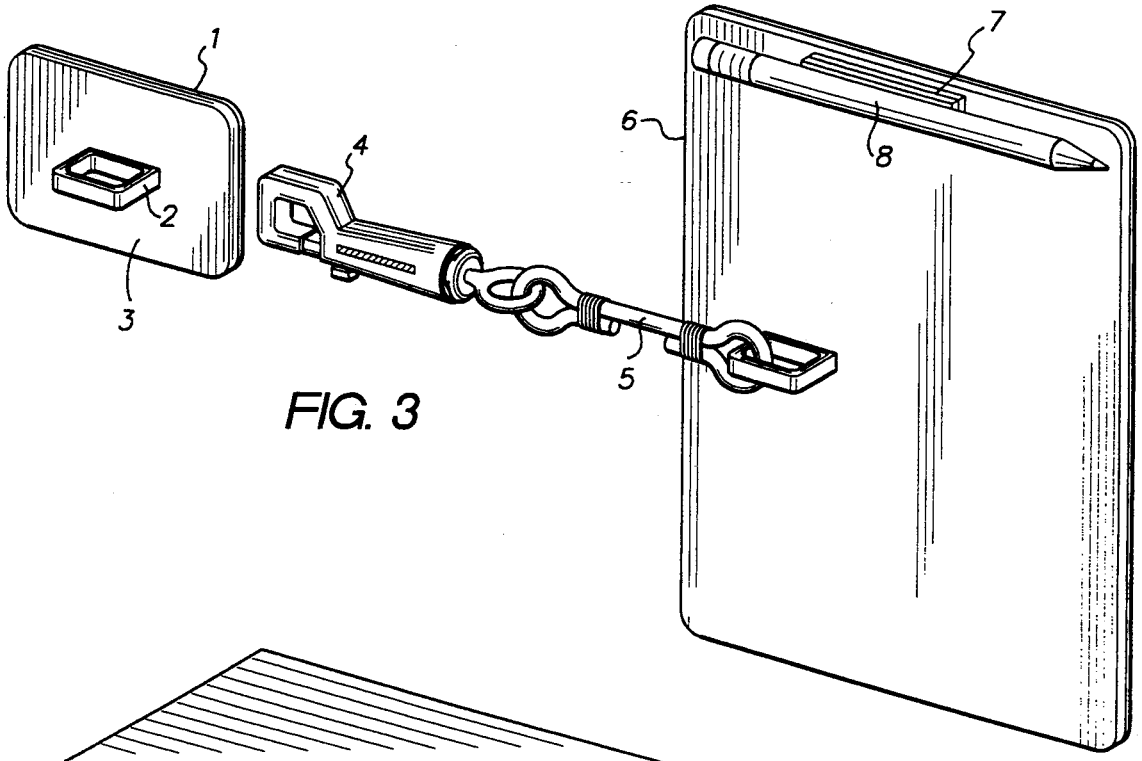
FIG. 3 Is an alternate embodiment of the mechanism.
Figure 4:
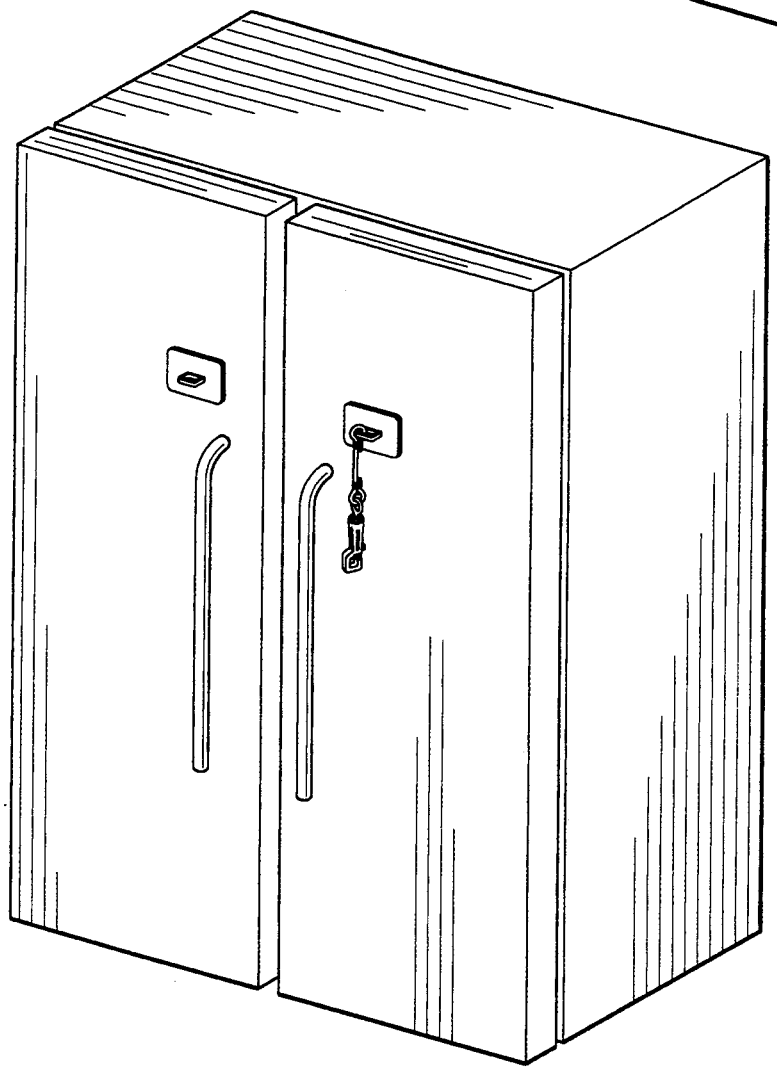
FIG. 4 is a view of a side by side refrigerator door with the device in a disabled configuration.
Figure 8:
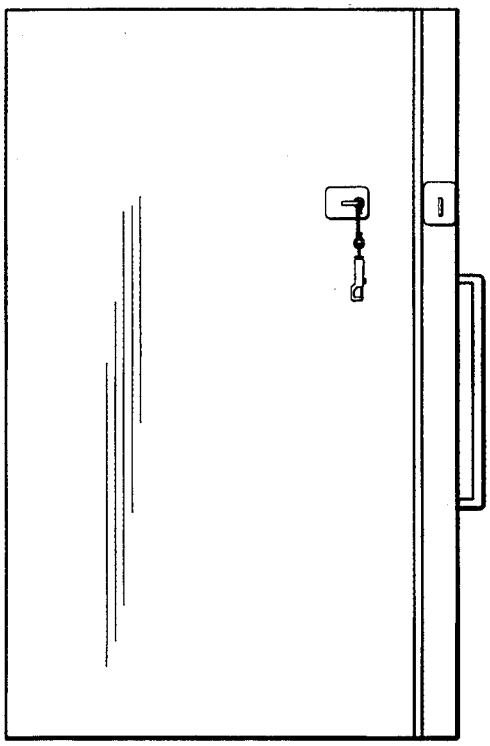
FIG. 8 Shows a side mounting for the refrigerator door of a top freezer compartment type refrigerator.
Figure 9:
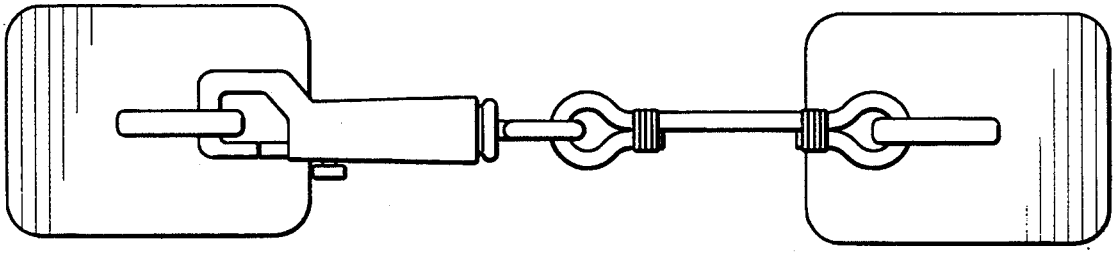
FIG. 9 Shows the sizes of the parts of the primary embodiment.

As shown in FIG. 1, a mounting plate $^{1a}$ is shown having an adhesive backing $^{1}$ and a loop $^{2}$ on its face $^{3}$. A second mounting plate $^{2a}$ is shown having a shock cord attached on one end to a loop on the mounting plate and a spring clasp $^{4}$. Referring to FIG. 2 two mounting plates are shown mounted to a refrigerator with a shock cord being shown attached on one end to the loop on one plate and the other end to a clasp. The clasp is shown hooked onto the loop. FIG. 3 shows a the same functional pieces described above with the addition that the mounting pad to which the shock cord is mounted to also comprises a note pad with pencil mounting means. FIG. 4 shows a refrigerator with the mechanism disabled thus allowing for normal operation of the refrigerator door when desired. FIG. 5 shows an alternate embodiment of the invention contemplated to be covered by this invention. FIGS. 6,7 and 8 show alternate mounting methods for different kinds of refrigerator doors. FIG. 9 shows size details of primary embodiment.

In operation and for purposes of illustration and not by way of limitation as other methods of attachment are readily obvious as are the attachment of other functional parts to the mounting plates such as, but not limited to, night lights, clocks, smoke detectors, motion detectors, alarms and can openers. The following is a description of how to use the invention.

1. assuming a side by side refrigerator door configuration one of the mounting plates is adhered to one of the refrigerator doors, near the door's opening edge, above the reach of children.

2. The other mounting plate is mounted on the adjacent door at a distance close enough to the edge of the door to allow the spring hook on the end of the shock cord sometimes herein referred to as lanyard to reach the other mounting plate loop with minimal or no tension apparent on the lanyard.

3. The lanyard with spring hook is hooked onto the loop and thus the refrigerator door can now only slightly be opened before the resistance in the lanyard increases to a degree that the door is kept from opening further and if the door is released the tension in the lanyard will shut the door as lanyard returns to its relaxed state. This enabled configuration is as shown in FIGS. 2 and 5.

What is claimed is:

1. A device for making a refrigerator door or other closure child resistant, comprising:

first and second mounting plates each having front and back sides and each being from 2 square inches to 100 square inches in area and from one sixteenth inch to one half inch thick and each having lanyard attaching means comprising a loop mounted to its front side in a perpendicular plane relative to the plane of the mounting plate and an adhesive surface on said back side of each mounting plate;

a length of shock cord hereafter referred to as, lanyard, having first and second ends with said lanyard first end mounted to said loop on said second mounting plate and a spring clasp mounted to said lanyard second end for attaching said lanyard second end to said first mounting plate.

2. The device of claim 1, wherein one or both of the mounting plates further comprise a writing surface.

3. The device of claim 1 wherein the shock cord is from 5 inches to 10 inches long and 5/16 inch in diameter and the spring clasp is made of plastic and has a swivel end attached to the shock cord and wherein said shock cord has a limited stretch capability of from about sixty percent of diameter to about 250 percent of diameter.

4. A kit for making a refrigerator door child resistant comprising: first and second mounting plates each having front and back sides and each having a loop mounted to its front side;

a shock cord having first and second ends with said shock cord first end mounted to said loop on said second mounting plate and a spring clasp mounted to said shock cord second end.

* * * * *